US005552085A

United States Patent [19]

Babaian-Kibala

[11] Patent Number: 5,552,085

[45] Date of Patent: Sep. 3, 1996

[54] PHOSPHORUS THIOACID ESTER INHIBITOR FOR NAPHTHENIC ACID CORROSION

[75] Inventor: Elizabeth Babaian-Kibala, Fulshear, Tex.

[73] Assignee: Nalco Chemical Company, Naperville, Ill.

[21] Appl. No.: 538,521

[22] Filed: Oct. 3, 1995

Related U.S. Application Data

[63] Continuation of Ser. No. 298,731, Aug. 31, 1994, abandoned.

[51] Int. Cl.[6] ..... C23F 11/16; C23F 11/167

[52] U.S. Cl. ..... 252/389.23; 252/395; 422/7; 208/47; 203/7; 585/950

[58] Field of Search ..... 252/389.23, 395; 422/7; 208/47; 203/7; 585/950

[56] References Cited

U.S. PATENT DOCUMENTS

| | | | |
|---|---|---|---|
| 3,228,758 | 1/1966 | Bauer | 208/47 |
| 3,531,394 | 4/1968 | Kozman . | |
| 3,553,150 | 1/1971 | Rosenwald et al. | 208/47 |
| 3,684,687 | 8/1972 | Carr et al. | 208/47 |
| 4,002,568 | 1/1977 | Jane et al. | 252/46.7 |
| 4,024,049 | 5/1977 | Shell et al. | 208/44 |
| 4,024,051 | 5/1977 | Shell et al. | 208/348 |
| 4,105,540 | 8/1978 | Weinland . | |
| 4,144,247 | 3/1979 | Jayner et al. | 260/329 P |
| 4,542,253 | 9/1985 | Kaplan et al. | 585/650 |
| 4,647,366 | 3/1987 | Edmondson et al. . | |
| 4,842,716 | 6/1989 | Kaplan et al. | 208/47 |
| 4,941,994 | 7/1990 | Zetmeisl et al. . | |
| 5,019,341 | 5/1991 | Niu et al. | 422/7 |
| 5,188,179 | 2/1993 | Gay et al. | 208/47 |
| 5,252,254 | 10/1993 | Babaian-Kibala | 208/47 |
| 5,354,450 | 10/1994 | Tong et al. | 208/48 AA |
| 5,464,525 | 11/1995 | Edmondson | 208/47 |
| 5,500,107 | 3/1996 | Edmondson | 208/47 |

*Primary Examiner*—Sharon Gibson
*Assistant Examiner*—Valerie Fee
*Attorney, Agent, or Firm*—Robert A. Miller; James J. Drake

[57] ABSTRACT

Corrosion of the metallic surfaces of distillation columns, trays, packing, and pumparound piping used in the production of hydrocarbons can be controlled by adding a neutralized or non-neutralized thio-phosphate or thio-phosphite ester to the hydrocarbon distillate contacting the metallic surfaces.

8 Claims, No Drawings

PHOSPHORUS THIOACID ESTER INHIBITOR FOR NAPHTHENIC ACID CORROSION

This application is a continuation of application Ser. No. 08/298,731, filed Aug. 31, 1994, now abandoned.

FIELD OF THE INVENTION

This invention relates to inhibitors for controlling naphthenic acid corrosion in distillation columns and pumparound piping used for the processing of hydrocarbon fluids, and more particularly to the use of thiophosphite and/or thiophosphate esters as naphthenic acid corrosion inhibitors in distillation columns, distillation column trays, pumparound piping, and associated equipment used in the processing of hydrocarbon fluids.

BACKGROUND OF THE INVENTION

It is widely known in the art that the processing of crude oil and its various fractions has led to damage to piping and other associated equipment due to naphthenic acid corrosion. Generally speaking, naphthenic acid corrosion occurs when the crude being processed has a neutralization number or total acid number (TAN), expressed as the milligrams of potassium hydroxide required to neutralize the acids in a one gram sample, above 0.2. It is also known that naphthenic acid-containing hydrocarbon is at a temperature between about 200° C. and 400° C. (approximately 400° F.–750° F.), and also when fluid velocities are high or liquid impinges on process surfaces e.g. in transfer lines, return bends and restricted flow areas. Additional background on the problem of naphthenic acid corrosion in oil refineries can be found in Gutzeit, Materials Performance, pp 24–35, October, 1977; Piehl, NACE Corrosion 87 Meeting, Paper No. 196, Mar. 9–13, 1987; and Scattergood et al., NACE Corrosion 87 Meeting, Paper No. 197, Mar. 9–14, 1987.

Various approaches to controlling naphthenic acid corrosion have included neutralization and/or removal of naphthenic acids from the crude being processed; blending low acid number oils with corrosive high acid number oils to reduce the overall neutralization number; and the use of relatively expensive corrosion-resistant alloys in the construction of the piping and associated equipment. These attempts are generally disadvantageous in that they require additional processing and/or add substantial costs to treatment of the crude oil. Alternatively, various amine and amide based corrosion inhibitors are commercially available, but these are generally ineffective in the high temperature environment of naphthenic acid corrosion. Naphthenic acid corrosion is readily distinguished from conventional fouling problems such as coking and polymer deposition which can occur in ethylene cracking and other hydrocarbon processing reactions using petroleum based feedstocks. Naphthenic acid corrosion produces a characteristic grooving of the metal in contact with the corrosive stream. In contrast, coke deposits generally have corrosive effects due to carburization, erosion and metal dusting.

U.S. Pat. No. 3,531,394 to Koszman described the use of phosphorus and/or bismuth compounds in the cracking zone of petroleum steam furnaces to inhibit coke formation on the furnace tube walls.

U.S. Pat. No. 4,024,049 to Shell et al discloses compounds substantially as described and claimed herein for use as refinery antifoulants. While effective as antifoulant materials, materials of this type have not heretofore been used as corrosion inhibitors in the manner set forth herein. While this reference teaches the addition of thiophosphate esters such as those used in the subject invention to the incoming feed, due to the non-volatile nature of the ester materials they do not distill into the column to protect the column, the pumparound piping, or further process steps. I have found that by injecting the thiophosphate esters as taught herein, surprising activity is obtained in preventing the occurrence of naphthenic acid corrosion in distillation columns, pumparound piping, and associated equipment U.S. Pat. No. 4,105,540 to Weinland describes phosphorus containing compounds as antifoulant additives in ethylene cracking furnaces. The phosphorus compounds employed are mono- and di-ester phosphate and phosphite compounds having at least one hydrogen moiety complexed with an amine.

U.S. Pat. No. 4,542,253 to Kaplan et al, described an improved method of reducing fouling and corrosion in ethylene cracking furnaces using petroleum feedstocks including at least 10 ppm of a water soluble mine complexed phosphate, phosphite, thiophosphate or thiophosphite ester compound, wherein the amine has a partition coefficient greater than 1.0 (equal solubility in both aqueous and hydrocarbon solvents).

U.S. Pat. No. 4,842,716 to Kaplan et al describes an improved method for reducing fouling and corrosion at least 10 ppm of a combination of a phosphorus antifoulant compound and a filming inhibitor. The phosphorus compound is a phosphate, phosphite, thiophosphate or thiophosphite ester compound. The filming inhibitor is an imidazoline compound.

U.S. Pat. No. 4,941,994 Zetmeisl et al discloses a naphthenic acid corrosion inhibitor comprising a dialkyl or trialkylphosphite in combination with an optional thiazoline.

Naphthenic Acid Corrosion in a Refinery Setting by Babaian-Kibala, Craig, Jr., Rusk, Blanchard, Rose, Uehlein, Quinter and Summers, Paper 631 of the 1993 NACE Annual Conference and Corrosion Show discloses the addition of certain phosphate esters to control corrosion in the high temperature areas of a distillation column by injection of the phosphate ester material into a draw tray and the packing above the heavy vacuum gas oil draw tray in a vacuum distillation tower. The injection of the phosphate ester in this manner reportedly lowered the corrosion rate in the tower.

While the art has suggested adding thio-phosphate materials of the type described herein to hydrocarbon distillation processes, the art has added such materials to the vessels containing the distilling petroleum fluid such as for example in the Weinland patent mentioned above. The non-volatile materials of this invention have accordingly not heretofore been applied to the surfaces of distillation columns, trays in distillation columns, pumparound piping, or the like which are susceptible to naphtheic acid corrosion. Accordingly, it would be very desirable to have available an enhanced naphthenic acid corrosion inhibitor for distillation columns and associated equipment including distillation trays and pumparound piping which is an effective naphthenic acid corrosion control additive.

SUMMARY OF THE INVENTION

The present invention involves the discovery that phosphorus thioacid ester compounds, especially such compounds which are non-neutralized, are very effective naphthenic acid corrosion inhibitors when present in very low concentrations in a hydrocarbon fluid or stream containing naphthenic acid. The materials are especially effective in preventing naphthenic acid corrosion in distillation columns, trays, pumparound piping and related equipment. This surprising discovery makes it possible to inhibit the corrosive effects of naphthenic acids in distilling hydrocarbons without the need for expensive corrosion resistant alloys to be used in distillation columns, strippers, trays, pumparound piping, and related equipment. The present invention also provides a longer catalyst life in fluidized catalytic hydrocarbon treating processes, since the iron content of the hydrocarbon recycled to a cracking unit can be reduced. The present invention thus addresses naphthenic acid corrosion which occurs in distillation columns, trays, pumparound piping and related equipment of petroleum processing units.

In one aspect, the invention provides an improvement to a process in which a hydrocarbon fluid containing a corrosive mount of naphthenic acid is distilled, the condensed liquid of such fluid contacting a ferrous metal surface. The improvement is characterized by contacting the ferrous metal surfaces contacted with the condensed liquid of the distilling hydrocarbon fluid or its condensed liquid with a corrosion inhibiting mount of phosphorus thioacid ester compounds.

In a further aspect, the invention provides a method for inhibiting naphthenic acid corrosion of the ferrous surfaces of distillation columns, trays, pumparound piping and related equipment by contacting the metallic surfaces thereof with a thioacid ester compound. The method includes the step of adding a phosphorus thioacid ester compound to a hydrocarbon liquid contacting the interior walls of a distillation column, trays, and pumparound piping and allowing the compound to contact the metallic components thereof. The method prevents corrosion of metallic surfaces exposed to naphthenic acids which distill and subsequently condense at upper portions of the distillate column. The method then includes the step of maintaining sufficient phosphorus thioacid ester in contact with the metallic components of the distillation column, trays, pumparound piping and equipment related thereto. Accordingly, the metal surfaces in the distillation column, trays, pumparound piping and related equipment can be protected by introducing a relatively high initial dose of the phosphorus thioacid ester for a relatively short period of time, and then reducing the dosage rate to a maintenance level.

This invention includes a method for preventing the deactivation of cracking catalysts with metallic corrosion products from distillation columns, trays, pumparound piping, and related equipment. By controlling corrosion metallic corrosion products are not passed into the distillation vessel, and thus do not become part of the bottoms material which is sometimes treated in catalytic processes. Thus the invention prevents the poisoning of catalysts.

The invention is particularly suitable for use in systems distilling crude oil, gas oil fractions, light lubricating oil fractions, atmospheric tower fractions, or vacuum tower fractions. The invention is applicable to preventing corrosion in distillation columns, trays, pumparound piping and equipment related thereto at temperatures of between 200° C. and 400° C., and particularly where the hydrocarbon mixture or stream being distilled has an acid number of 0.2 or more. The phosphorus thioacid ester is preferably present in hydrocarbon contacting the walls of distillation columns, trays, pumparound piping, and related equipment at a level of from 5 to 200 ppm. The ester moiety (or moieties) of the phosphorus thioacid inhibitor preferably comprises a hydrocarbyl group having from 5–30 carbon atoms. Thiophosphate isooctyl ester has been found to be a particularly effective material in inhibiting naphthenic acid corrosion.

DETAILED DESCRIPTION OF THE INVENTION

The phosphorus thioacid ester compounds useful in the present invention have the following general formula:

(1) thio-phosphates:

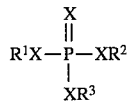

and (2) thio-phosphites (a) or (b)

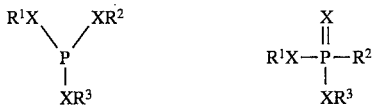

wherein each X is independently chalcogen, preferably oxygen or sulfur, provided that at least one X is sulfur; $R^1$, $R^2$ and $R^3$ are independently hydrogen or hydrocarbyl, or together form a divalent hydrocarbylidene or trivalent hydrocarbylidyne, having 5 or more carbon atoms, preferably from 5 to 30 carbon atom, provided that at least one of $R^1$, $R^2$, and $R^3$ is not hydrogen. A compound selected from formulae (1) and (2) typically comprises from about 5 to about 60 carbon atoms but preferably from about 5 to 20. In general, the size and number of the hydrocarbyl moieties is sufficient for solubility in the corrosive hydrocarbon.

The present inhibitors include mono-, di- and trihydrocarbyl thio, dithio-, trithio-and thiophosphates and thio-, dithio-, and trithiophosphites, wherein the hydrocarbyl moieties are S-substituted, O-substituted or a combination of S- and O-substituted. In one preferred embodiment, at least one of $R^1$, $R^2$ and $R^3$ is hydrogen, i.e., the phosphorus thioacid ester is a partial ester having one or two acidic hydroxyl or thiol moieties, or a combination of each. It is also possible to neutralize the partial ester, for example, with amine cations, although this neutralization has surprisingly been found to not improve the inhibition of naphthenic acid corrosion. It is also suitable to use a mixture or combination of X, $R^1$, $R^2$, and/or $R^3$ and compounds thereof.

Representative examples of suitable hydrocarbyls include pentyl, hexyl 2-methylheptyl, heptyl, octyl, nonyl, decyl, undecyl, dodecyl, cyclohexyl, phenyl, benyl, butylenephenyl, pentylphenyl and the like. Also, a mixture or combination of hydrocarbyls can be used, especially where the alcohol, thiol or other reactant used to prepare the inhibitor contains a mixture or combination of species, e.g. an isomer or a minor impurity. Combinations and mixtures of hydrocarbyls in the inhibitor can also be obtained by stepwise reaction methodologies.

As representative examples of the phosphorus thioacid esters, and certainly not as an exhaustive or complete listing of them all, there can be mentioned:

S- or O-pentyl phosphorothioate, neutralized or non-neutralized; S,O- or O,O-diisooctyl phosphorothioate; neutralized or non-neutralize, S,O,O- or O,O,O-tridecyl phosphorothioate; S,S,O- or S,S,S-trioctyl phosphorotrithioate; tripentyl phosphorotetrathioate; S- or O-octyl thiophosphite, neutralized or non-neutralized; S,O- or S,S-dioctyl dithiophosphite, neutralized or non-neutralized; thioctyl trithiophosphite, and the like.

The present invention is not especially concerned with the manner of thiophosphate and thiophosphite ester preparation. Thiophosphate ester compounds are readily prepared as the reaction product, for example, of phosphorus pentasulfide ($P_2S_5$) and an alcohol and/or thio in a suitable diluent. Preferably, the reactants are employed at the stoichiometry of the desired thiophosphate ester compound to obtain a relatively pure product as the reaction tends to go to completion. Alternatively, a pentavalent phosphorus halide, e.g. phosphorus oxychloride or oxybromide, can be reacted with a stoichiometric amount of an appropriate thiol compound. Reaction conditions employed generally depend on the diluent used and the reactivity of the alcohol and/or thiol. Where different alkyl group substituents are desired, mixtures of alcohols and/or thiols are used, and sequential reactions can be used to control the esterification reaction.

Thiophosphite ester compounds are readily prepared by means known in the art. As one exemplary preparation method, a phosphorus trihalide such as phosphorus trichloride can be reacted with a stoichiometric amount of a suitable thiol. The reaction is typically conducted in a suitable diluent at an elevated temperature and will go to completion. Sequential reactions can be used if different alkyl thioester groups are desired. Reaction conditions employed generally depend on the reactivity and solubility of the thiol compounds.

Mono and diester thiophosphate and thiophosphite compounds having 1 or 2 acidic hydrogen moieties, can be readily neutralized by a suitable base. Preferred neutralizing bases are amine compounds. Preferred neutralizing mines are tertiary amines wherein the amine alkyl groups independently have 5 or more carbon atoms. Examples of suitable amines include morpholine, tri-n-hexylamine, triisooctylamine, tri-n-decylamine, tri-n-hexadecylamine, and the like. Mono- or di-ester thiophosphate or thiophosphite compounds can typically be neutralized at ordinary conditions by the simple addition of a stoichiometric quantity of the desired amine compound followed by agitation. In the case of mono- and di-ester preparation, it can be desirable to treat the reaction product following esterification with water, dilute aqueous caustic or mineral acid to hydrolyze residual halide groups formed from the particular trivalent or pentavalent phosphorus halide compound used as reactant.

The invention is directed to a method for inhibiting corrosion on the metal surfaces of a distillation unit used in the distillation of hydrocarbons containing naphthenic acids. The invention is practiced in its simplest form by the following steps:

a. heating the hydrocarbon containing naphthenic acid to vaporize a portion of the hydrocarbon;

b. allowing the hydrocarbon vapors to rise in a distillation column;

c. condensing a portion of the hydrocarbon vapors passing through the distillation column to produce a distillate;

d. adding to the distillate from 5 to 200 ppm of a phosphorus thioacid hydrocarbyl ester;

e. allowing the distillate containing the phosphorus thioacid hydrocarbyl ester to contact substantially all of the metal surfaces of the distillation unit to form a proctective film on such surface whereby such surface is inhibited against corrosion.

It is advantageous to treat distillation column, trays, pumparound piping and related equipment to prevent naphthenic acid corrosion when condensed vapors from distilled hydrocarbon fluids contact metallic equipment at temperatures greater than about 200° C. and preferably 400° C. The phosphorus thioacid ester additive is generally added to the condensed distillate, and the condensed distillate is allowed to contact the metallic surfaces of the distillation column, packing, trays, pumparound piping, and related equipment as the condensed distillate passes down the column and into the distillation vessel. The distillate may also be collected as product. The corrosion inhibitors of the invention remain in the resultant collected product.

In commercial practice, the additives of this invention may be added to a distillate return to control corrosion in a draw tray and in the column packing while a second injection may be added to a spray oil return immediately below the draw trays to protect the tower packing and trays below the distillate draw tray. It is not so critical where the additive of the invention is added so long as it is added to distillate that is later returned to the distillation vessel, or which contacts the metal interior surfaces of the distillation column, trays, packing, pumparound piping, and related equipment.

Generally, a phosphorus thioacid ester concentration of from about 1 to about 10,000 ppm or more added to the distillate can be effective, but a concentration level of from 5 to 200 ppm is generally preferred to achieve the desired level of corrosion inhibition at a reasonable economy. In starting applications of the type described herein, the phosphorus thioacid ester is preferably added to the distillate in contact with the metal surfaces of distillation columns, trays, packing, pumparound piping, and equipment related thereto at a relatively high initial concentration for a relatively short period of time to form a protective corrosion inhibiting layer on the iron containing metal surfaces exposed to the distillate. Thereafter, the dosage of the phosphorus thioacid ester can be reduced to a maintenance level required to maintaining the protective barrier layer. The amount of phosphorus thioacid ester required to obtain the same general degree of corrosion inhibition usually increases as the velocity of the hydrocarbon fluid increases, or as the rate of distillation increases, increasing the amount of naphthenic acids potentially present in the column, trays, packing, pumparound piping, and related equipment.

The phosphorus thioacid ester can be added to the distillate fluid which contacts metallic equipment on which naphthenic acid corrosion is to be inhibited at any convenient point, e.g. by metering the appropriate amount of the phosphorus thioacid ester into the distillate at a point where it will be admixed, and will flow downward to contact the metallic surfaces. Preferably, the phosphorus thioacid ester is added as a concentrated master batch of 10–75 weight percent phosphorus thioacid ester in an appropriately selected solvent such as, for example, the distillate being produced in the column being treated, mineral oil, aliphatic and aromatic solvents, naphtha, toluene, benzene or the like. The phosphorus thioacid ester can be added to the distillate using inline mixers, or simply turbulence of the fluid in the distillation unit itself.

While compounds of the present invention have been utilized for the treatment of refinery process streams to prevent fouling, such as for instance in Shell, U.S. Patent which is hereinafter incorporated by reference into this specification, I have now found that it is extremely useful in controlling naphthenic acid corrosion to add the thiophosphate esters of the subject invention to the column pumparound piping, and to the individual distillation trays present in the column in order that corrosion in the column and pumparound piping may be controlled.

A convenient location to add the compounds of this invention is in the return trays and draw trays of distillation units so that sufficient inhibitor coats the interior of the entire column and associated equipment. Because of the relative non-volatility of the compounds used in the subject invention, the compounds remain available, at the injected site to coat the metallic distillation column, trays, pumparound piping and associated equipment, protecting them from naphthenic acid materials. If excess material is added, it may flow down the column, into the distillation vessel where it is recovered in the non-distilled material or heavy residue.

The invention is illustrated by the following examples.

EXAMPLE 1

A non-neutralized thiophosphate ester (NNTPE) was prepared. A mixture of $C_8/C_{10}$ alcohols, obtained under the designation ALFOL 810 from Vista Chemicals (47 g) and heavy aromatic naphtha diluent (50 g) were mixed in a 250 ml 4-neck flask equipped with a solid addition funnel, stirrer and a temperature controller. $P_2S_5$ (20 g) was slowly added and the temperature was increased to 110° C. Upon addition of the $P_2S_5$, hydrogen sulfide was released. After 1 hour, the $H_2S$ evolution ceased and the temperature was increased to 140° C. for 1 hour. A clear yellow product was collected.

EXAMPLE 2

A neutralized thiophosphate ester (NTPE) was prepared similarly to the procedure outlined in Example 1 except that isooctyl alcohol was used in place of the ALFOL 810, and the molar ratio of $P_2S_5$ to isooctyl alcohol was 1:4 to produce primarily diester. The diester was recovered and neutralized using 3.8 g of morpholine.

EXAMPLES 3–4

In the following examples, the thiophosphate ester compounds of Examples 1 and 2 were tested for naphthenic acid corrosion inhibition using carbon steel coupons. Hydrocarbon fluids were prepared using terrestic oil and commercially available naphthenic acid. The neutralization numbers of the terrestic oil were adjusted to be about 5.5 for Example 3, and 12 for Example 4. A slightly modified beaker test was used to analyze the inhibitor for naphthenic acid corrosion control. A 2-liter, 4-neck round bottom flask equipped with a mechanical stirrer and a Dean-Stark trap connected to a condenser was used. The temperature was controlled by a temperature controller. The thiophosphate inhibitor was introduced to the fluid under agitation at 93° C. (200° F.). The temperature was raised to 260° C. (500° F.) for 6 hours. The coupon was removed, excess oil rinsed, and the excess corrosion products were removed from the coupon using steel wool. The coupon was weighed, and the percent inhibition and corrosion rate were calculated. Results are given in Table 1 below. Excellent naphthenic acid corrosion inhibition was obtained.

EXAMPLES 5–6

The procedure of Examples 3–4 was followed except that heavy vacuum gas oil (HVGO) was used instead of terrestic oil. The results of these examples are also presented in Table 1.

EXAMPLE 7

A non-neutralized thiophosphate thioester (NNTPTE) was obtained by first placing 6.0 ml of 1-octanethiol and 32 g heavy aromatic naphtha in a 100 ml, three-neck round bottom flask equipped with a stirrer and a temperature controller, and heating the mixture at 110° C. Then 10 g of $P_2S_5$ was added, the mixture heated to 150° C. for about 2 hours, and the NNTPTE reaction product recovered. The NNTPTE was then used in corrosion inhibition procedures similar to Examples 3–6. The results are presented in Table 1 below.

Comparative Examples

For the purpose of comparing the corrosion inhibition obtained by the present phosphorothioates with that of the corresponding phosphates, the corrosion tests were done using two phosphate esters commercially available from Nalco Chemical Company under the designations Nalco 5180 and 92RB186. Nalco 5180 and 92RB186 are designated compositions 1 and 2 and were used in corrosion inhibition procedures similar to Examples 3–6. Results are shown in Table 1.

TABLE 1

| Example | Hydrocarbon Fluid | Acid Number (TAN) | Additive | Additive Content (ppm) | Corrosion Rate MPY | Corrosion Rate mm/yr | Corrosion Inhibition (%) |
|---|---|---|---|---|---|---|---|
| 3 | Terrestic Oil | 5.5 | NTPE | 0 | 198 | 5.03 | 0 |
| | | | | 10,000 | 69 | 1.75 | 65 |
| 4 | Terrestic Oil | 12 | NNTPE | 0 | 125 | 3.18 | 0 |
| | | | | 500 | 18 | 0.46 | 86 |
| 5 | HVGO | 4.5 | NTPE | 0 | 46 | 0.69 | 0 |
| | | | | 200 | 5 | 0.13 | 89 |
| | | | | 500 | 1.5 | 0.04 | 95 |
| 6 | HVGO | 4.5 | NNTPE | 0 | 46 | 0.69 | 0 |
| | | | | 500 | 1.5 | 0.04 | 96 |
| 8 | Terrestic Oil | 12 | NNTPTE | 0 | 125 | 3.18 | 0 |
| | | | | 200 | 1.7 | 0.04 | 99 |
| | | | | 500 | 12.4 | .031 | 90 |
| | | | | 1000 | 3.4 | 0.09 | 97 |
| Comp. 1 | Terrestic Oil | 12 | | 0 | 109 | 2.77 | 0 |
| | | | | 500 | 77 | 1.96 | 29 |
| | | | | 5000 | 10.7 | 0.27 | 90 |
| Comp. 2 | Terrestic Oil | 12 | | 0 | 125 | 3.18 | 0 |
| | | | | 500 | 99 | 2.51 | 20 |
| | | | | 1000 | 10.5 | 0.27 | 92 |
| | | | | 1500 | 0.9 | 0.02 | 99 |

From the foregoing results, it is seen that thiophosphate esters are surprisingly effective in inhibiting naphtheic acid corrosion in two different acidic hydrocarbon fluids. Quite surprisingly, the non-neutralized inhibitors are seen to be as or more effective compared to the neutralized inhibitor. The phosphate esters, while effective, generally required a much higher concentration level to obtain the same degree of corrosion inhibition obtained with the non-neutralized thiophosphates at 200–500 ppm.

The invention is illustrated by way of the foregoing description and examples. The foregoing description is intended as a non-limiting illustration, since many variations will become apparent to those skilled in the art in view thereof. It is intended that all such variations within the scope and spirit of the appended claims be embraced thereby.

I claim:

1. A process for controlling corrosion on the metallic surfaces of distillation columns, trays, packing, and pumparound piping in contact with the condensed distillate of a distilling hydrocarbon containing naphthenic acids which comprises adding a phosphorus thioacid hydrocarbyl ester to the condensed distillate and allowing such condensed distillate containing the phosphorus thioacid hydrocarbyl ester to contact the metallic surfaces of the distillation column, trays, packing, and pumparound piping.

2. A method for inhibiting corrosion on the metal surfaces of a distillation unit used in the distillation of hydrocarbons containing naphthenic acids which comprises:

a. heating the hydrocarbon containing naphthenic acid in a distillation vessel to vaporize a portion of the hydrocarbon;

b. allowing the hydrocarbon vapors to rise in the distillation column;

c. condensing a portion of the hydrocarbon vapors passing through the distillation column to produce a condensed distillate;

d. adding to the condensed distillate, before said condensed distillate is returned to the distillation vessel, or collected as product from 5 to 200 ppm of a phosphorus thioacid hydrocarbyl ester;

e. allowing the condensed distillate containing the phosphorus thioacid hydrocarbyl ester to contact the metal surfaces of the distillation unit to form a protective film on such surfaces whereby such surface is inhibited against corrosion; and, f. allowing the condensed distillate to return to the distillation vessel, or to be collected as product.

3. The method of claim 2 wherein the hydrocarbon is at a temperature of greater than 200° C. and the hydrocarbon has an acid number of 0.2 or greater.

4. The method of claim 3 whereto the hydrocarbon is selected from the group consisting of crude oil, a refinery gas oil fraction, a refinery light oil fraction, refinery atmospheric tower bottoms, and refinery vacuum tower bottoms.

5. The method of claim 3 whereto the ester substituent of the phosphorus thioacid alkyl ester comprises alkyl having from 5 to 30 carbon atoms and the phosphorous thioacid alkyl ester is present in the distillate at from 5–200 ppm.

6. The method of claim 3 wherein the phosphorous thioacid ester comprises hydrocarbyl ester of the formula:

(1) thiophosphates:

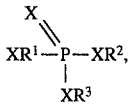

or (2) thiophosphites:

(a) or (b)

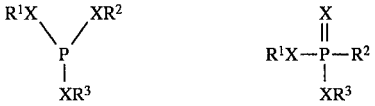

wherein each X is independently chalcogen, provided that at least one X is sulfur, and wherein $R^1$, $R^2$, and $R^3$ are independently hydrogen, or hydrocarbyl having from 5 to 30 carbon atoms, provided that at least one of $R^1$, $R^2$, and $R^3$ is not hydrogen.

7. The method of claim 6 whereto the ester is a non-neutralized partial ester wherein one or two of $R^1$, $R^2$, and $R^3$ are hydrogen.

8. The method of claim 6 wherein the ester is neutralized with an amine.

* * * * *